US007001254B2

(12) United States Patent
Taylor

(10) Patent No.: US 7,001,254 B2
(45) Date of Patent: Feb. 21, 2006

(54) APPARATUS AND METHOD FOR CONDITIONING A CONTACT SURFACE OF A PROCESSING PAD USED IN PROCESSING MICROELECTRONIC WORKPIECES

(75) Inventor: Theodore M. Taylor, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 200 days.

(21) Appl. No.: 10/910,692

(22) Filed: Aug. 2, 2004

(65) Prior Publication Data

US 2005/0014457 A1 Jan. 20, 2005

Related U.S. Application Data

(62) Division of application No. 09/939,432, filed on Aug. 24, 2001, now Pat. No. 6,866,566.

(51) Int. Cl.
*B24B 1/00* (2006.01)

(52) U.S. Cl. ..... 451/56; 451/53; 451/443; 451/444

(58) Field of Classification Search ..... 451/7, 451/53, 54, 56, 72, 57, 60, 285–290, 443, 451/444; 51/636.1, 645.1; 125/11.03
See application file for complete search history.

(56) References Cited

U.S. PATENT DOCUMENTS

| | | | |
|---|---|---|---|
| 4,793,895 | A | 12/1988 | Kaanta et al. |
| 5,020,283 | A | 6/1991 | Tuttle |
| 5,036,015 | A | 7/1991 | Sandhu et al. |
| 5,069,002 | A | 12/1991 | Sandhu et al. |
| 5,196,353 | A | 3/1993 | Sandhu et al. |
| 5,216,843 | A | 6/1993 | Breivogel et al. |
| 5,222,329 | A | 6/1993 | Yu |
| 5,232,875 | A | 8/1993 | Tuttle et al. |
| 5,240,552 | A | 8/1993 | Yu et al. |
| 5,244,534 | A | 9/1993 | Yu et al. |
| 5,245,790 | A | 9/1993 | Jerbic |
| 5,314,843 | A | 5/1994 | Yu et al. |
| 5,372,673 | A | 12/1994 | Stager et al. |
| 5,399,234 | A | 3/1995 | Yu et al. |
| 5,433,651 | A | 7/1995 | Lustig et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,522,965 | A | 6/1996 | Chisholm et al. |
| 5,540,810 | A | 7/1996 | Sandhu et al. |
| 5,609,718 | A | 3/1997 | Meikle |
| 5,616,069 | A | 4/1997 | Walker et al. |
| 5,618,381 | A | 4/1997 | Doan et al. |
| 5,624,303 | A | 4/1997 | Robinson |
| 5,643,048 | A | 7/1997 | Iyer |
| 5,645,471 | A | 7/1997 | Strecker |
| 5,645,682 | A | 7/1997 | Skrovan |
| 5,650,619 | A | 7/1997 | Hudson |
| 5,655,951 | A | 8/1997 | Meikle et al. |

(Continued)

*Primary Examiner*—Lee D. Wilson
*Assistant Examiner*—Anthony Ojini
(74) *Attorney, Agent, or Firm*—Perkins Coie LLP

(57) ABSTRACT

Conditioning devices, systems and methods for conditioning a contact surface of a processing pad used in processing microelectronic workpieces. One embodiment of a conditioning device comprises an end-effector having a conditioning surface configured to engage the contact surface of the processing pad and a plurality of microstructures on the conditioning surface. The microstructures can be arranged in a pattern corresponding to a desired pattern of microfeatures on the contact surface of the processing pad. In several embodiments, the microstructures are raised elements projecting from the conditioning surface and/or depressions in the conditioning surface. The condition surface can also be smooth. The conditioning device can also include a heater coupled to the end-effector for heating the processing pad.

22 Claims, 5 Drawing Sheets

U.S. PATENT DOCUMENTS 5,658,190 A 8/1997 Wright et al.
5,663,797 A 9/1997 Sandhu
5,665,656 A * 9/1997 Jairath ..... 438/692
5,679,065 A 10/1997 Henderson
5,681,423 A 10/1997 Sandhu et al.
5,690,540 A 11/1997 Elliott et al.
5,698,455 A 12/1997 Meikle et al.
5,702,292 A 12/1997 Brunelli et al.
5,725,417 A 3/1998 Robinson
5,736,427 A 4/1998 Henderson
5,738,567 A 4/1998 Manzonie et al.
5,747,386 A 5/1998 Moore
5,769,697 A * 6/1998 Nishio ..... 451/288
5,775,983 A * 7/1998 Shendon et al. ..... 451/444
5,779,521 A * 7/1998 Muroyama et al. ..... 451/56
5,779,522 A 7/1998 Walker et al.
5,782,675 A 7/1998 Southwick
5,792,709 A 8/1998 Robinson et al.
5,795,218 A 8/1998 Doan et al.
5,795,495 A 8/1998 Meikle
5,798,302 A 8/1998 Hudson et al.
5,801,066 A 9/1998 Meikle
5,823,855 A 10/1998 Robinson
5,830,806 A 11/1998 Hudson et al.
5,846,336 A 12/1998 Skrovan
5,855,804 A 1/1999 Walker
5,868,896 A 2/1999 Robinson et al.
5,871,392 A 2/1999 Meikle et al.
5,879,222 A 3/1999 Robinson
5,879,226 A 3/1999 Robinson
5,882,248 A 3/1999 Wright et al.
5,893,754 A 4/1999 Robinson et al.
5,894,852 A 4/1999 Gonzales et al.
5,895,550 A 4/1999 Andreas
5,910,043 A 6/1999 Manzonie et al.
5,910,846 A 6/1999 Sandhu
5,934,980 A 8/1999 Koos et al.
5,938,801 A 8/1999 Robinson
5,954,912 A 9/1999 Moore
5,957,750 A * 9/1999 Brunelli ..... 451/7
5,972,792 A 10/1999 Hudson
5,975,994 A * 11/1999 Sandhu et al. ..... 451/56
5,976,000 A 11/1999 Hudson
5,980,363 A 11/1999 Meikle et al.
5,981,396 A 11/1999 Robinson et al.
5,989,470 A 11/1999 Doan et al.
5,994,224 A 11/1999 Sandhu et al.
5,997,384 A 12/1999 Blalock
6,022,266 A * 2/2000 Bullard et al. ..... 451/56
6,036,586 A 3/2000 Ward
6,039,633 A 3/2000 Chopra
6,040,245 A 3/2000 Sandhu et al.
6,046,111 A 4/2000 Robinson
6,054,015 A 4/2000 Brunelli et al.
6,057,602 A 5/2000 Hudson et al.
6,077,785 A 6/2000 Andreas
6,083,085 A 7/2000 Lankford
6,106,351 A 8/2000 Raina et al.
6,108,092 A 8/2000 Sandhu
6,110,820 A 8/2000 Sandhu et al.
6,114,706 A 9/2000 Meikle et al.
6,120,354 A 9/2000 Koos et al.
6,124,207 A 9/2000 Robinson et al.
6,139,402 A 10/2000 Moore
6,143,123 A 11/2000 Robinson et al.
6,186,870 B1 2/2001 Wright et al.
6,187,681 B1 2/2001 Moore
6,190,494 B1 2/2001 Dow
6,191,037 B1 2/2001 Robinson et al.
6,191,864 B1 2/2001 Sandhu
6,200,901 B1 3/2001 Hudson et al.
6,203,407 B1 3/2001 Robinson
6,203,413 B1 * 3/2001 Skrovan ..... 451/72
6,206,754 B1 3/2001 Moore
6,206,759 B1 3/2001 Agarwal et al.
6,206,769 B1 3/2001 Walker
6,210,257 B1 4/2001 Carlson
6,213,845 B1 4/2001 Elledge
6,227,955 B1 5/2001 Custer et al.
6,234,877 B1 5/2001 Koos et al.
6,234,878 B1 5/2001 Moore
6,238,270 B1 5/2001 Robinson
6,238,273 B1 5/2001 Southwick
6,244,944 B1 6/2001 Elledge
6,250,994 B1 6/2001 Chopra et al.
6,261,163 B1 7/2001 Walker et al.
6,271,139 B1 8/2001 Alwan et al.
6,273,101 B1 8/2001 Gonzales et al.
6,273,800 B1 8/2001 Walker et al.
6,284,660 B1 9/2001 Doan
6,287,879 B1 9/2001 Gonzales et al.
6,290,572 B1 9/2001 Hofmann
6,296,557 B1 10/2001 Walker
6,301,006 B1 10/2001 Doan
6,306,008 B1 * 10/2001 Moore ..... 451/5
6,306,014 B1 10/2001 Walker et al.
6,309,282 B1 10/2001 Wright et al.
6,312,558 B1 11/2001 Moore
6,319,420 B1 11/2001 Dow
6,323,046 B1 11/2001 Agarwal
6,325,702 B1 12/2001 Robinson
6,328,632 B1 12/2001 Chopra
6,331,135 B1 12/2001 Sabde et al.
6,331,139 B1 12/2001 Walker et al.
6,331,488 B1 12/2001 Doan et al.
6,343,977 B1 * 2/2002 Peng et al. ..... 451/56
6,350,180 B1 2/2002 Southwick
6,350,691 B1 2/2002 Lankford
6,352,466 B1 3/2002 Moore
6,352,470 B1 3/2002 Elledge
6,361,400 B1 * 3/2002 Southwick ..... 451/6
6,387,289 B1 5/2002 Wright
6,428,386 B1 8/2002 Bartlett
6,439,986 B1 * 8/2002 Myoung et al. ..... 451/443
6,500,054 B1 * 12/2002 Ma et al. ..... 451/56

* cited by examiner

APPARATUS AND METHOD FOR CONDITIONING A CONTACT SURFACE OF A PROCESSING PAD USED IN PROCESSING MICROELECTRONIC WORKPIECES

CROSS REFERENCE TO RELATED APPLICATION

This application is a divisional of U.S. patent application Ser. No. 09/939,432, filed Aug. 24, 2001, entitled "APPARATUS AND METHOD FOR CONDITIONING A CONTACT SURFACE OF A PROCESSING PAD USED IN PROCESSING MICROELECTRONIC WORKPIECES," now U.S. Pat. No. 6,866,566, issued Mar. 15, 2005, which is herein incorporated by reference in its entirety.

TECHNICAL FIELD

The present invention is related to end-effectors, conditioning machines, planarizing machines and methods for conditioning a contact surface of a processing pad used in processing microelectronic workpieces. The processing pads can be planarizing pads used in chemical-mechanical planarization and/or electrochemical-mechanical deposition processes.

BACKGROUND

Mechanical and chemical-mechanical planarizing processes (collectively "CMP") remove material from the surface of semiconductor wafers, field emission displays or other microelectronic substrates in the production of microelectronic devices and other products. FIG. 1 schematically illustrates a CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 has a head 32 to which a substrate 12 may be attached, or the substrate 12 may be attached to a resilient pad 34 in the head 32. The head 32 may be a free-floating wafer carrier, or an actuator assembly 36 may be coupled to the head 32 to impart axial and/or rotational motion to the substrate 12 (indicated by arrows H and I, respectively).

The planarizing pad 40 and a planarizing solution 44 on the pad 40 collectively define a planarizing medium that mechanically and/or chemically-mechanically removes material from the surface of the substrate 12. The planarizing pad 40 can be a soft pad or a hard pad. The planarizing pad 40 can also be a fixed-abrasive planarizing pad in which abrasive particles are fixedly bonded to a suspension material. In fixed-abrasive applications, the planarizing solution 44 is typically a non-abrasive "clean solution" without abrasive particles. In other applications, the planarizing pad 40 can be a non-abrasive pad composed of a polymeric material (e.g., polyurethane), resin, felt or other suitable materials. The planarizing solutions 44 used with the non-abrasive planarizing pads are typically abrasive slurries with abrasive particles suspended in a liquid.

To planarize the substrate 12 with the CMP machine 10, the carrier assembly 30 presses the substrate 12 face-downward against the polishing medium. More specifically, the carrier assembly 30 generally presses the substrate 12 against the planarizing liquid 44 on a planarizing surface 42 of the planarizing pad 40, and the platen 20 and/or the carrier assembly 30 move to rub the substrate 12 against the planarizing surface 42. As the substrate 12 rubs against the planarizing surface 42, material is removed from the face of the substrate 12.

CMP processes should consistently and accurately produce a uniformly planar surface on the substrate to enable precise fabrication of circuits and photo-patterns. During the construction of transistors, contacts, interconnects and other features, many substrates develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices on a substrate.

In the highly competitive semiconductor industry, it is also desirable to maximize the throughput of CMP processing by producing a planar surface on a substrate as quickly as possible. The throughput of CMP processing is a function, at least in part, of the polishing rate of the substrate assembly and the ability to accurately stop CMP processing at a desired endpoint. Therefore, it is generally desirable for CMP processes to provide (a) a uniform polishing rate across the face of a substrate to enhance the planarity of the finished substrate surface, and (b) a reasonably consistent polishing rate during a planarizing cycle to enhance the accuracy of determining the endpoint of a planarizing cycle.

One concern of CMP processing using soft pads is that they may not produce a flat, planar surface on the workpiece because they may conform to the topography of the workpiece. Soft pads also have a relatively short life span because the conditioning devices and the abrasive slurries wear away soft pads. Therefore, many current planarizing applications use hard pads to overcome the drawbacks of soft pads.

Although hard pads can be an improvement over soft pads, hard pads can be difficult to "condition" to bring the planarizing surface into a desired state for accurately planarizing workpieces. To condition a hard pad, an end-effector having small diamond particles can be rubbed across the surface of the planarizing pad to form microscratches in the pad surface. However, the microscratches are generally formed in a relatively random pattern because the diamond end-effector is swept across the pad surface while the pad rotates. The conditioned surface can vary, which can cause variances in planarizing results throughout a run of wafers or from one pad to another. Moreover, the diamond particles on the end-effector may break off during the conditioning cycle, which can produce defects in the planarizing pad or remain on the planarizing pad during a planarizing cycle and produce defects in the wafers. Hard polishing pads can accordingly be difficult to maintain.

A serious concern of using hard pads with raised microfeatures is that conditioning the planarizing surface with a diamond end-effector can significantly alter the size and shape of the raised features. The desired microfeatures on hard polishing pads are arranged in patterns with very precise sizes, shapes and spacings between the microfeatures. It will be appreciated that abrading the bearing surfaces of the microfeatures may alter the size and shape of the microfeatures in a manner that alters the planarizing characteristics of the polishing pad. Therefore, it would be desirable to develop a process for conditioning hard polishing pads in a manner that preserves the integrity of the planarizing surface.

SUMMARY OF THE INVENTION

The present invention is directed toward devices, systems and methods for conditioning a contact surface of a processing pad used in processing microelectronic workpieces. One embodiment of a conditioning device comprises an end-effector having a conditioning surface configured to engage the contact surface of the processing pad and a plurality of microstructures on the conditioning surface. The microstructures can be arranged in a pattern corresponding to a desired pattern of microfeatures on the contact surface of the processing pad. In several embodiments, the microstructures are raised elements projecting from the conditioning surface and/or depressions in the conditioning surface. The conditioning surface can also be smooth. The conditioning device can also include a heater coupled to the end-effector for heating the processing pad.

DETAILED DESCRIPTION

The following disclosure describes conditioning assemblies, planarizing machines with conditioning assemblies, and methods for conditioning processing pads used in chemical-mechanical planarization and electrochemical-mechanical planarization/deposition of microelectronic workpieces. The microelectronic workpieces can be semiconductor wafers, field emission displays, read/write media, and many other types of workpieces that have microelectronic devices with miniature components. Many specific details of the invention are described below with reference to rotary planarizing applications to provide a thorough understanding of such embodiments. The present invention, however, can also be practiced using web-format planarizing machines and electrochemical-mechanical planarization/deposition machines. Suitable web-format machines that can be adapted for use with the present invention include U.S. application Ser. Nos. 09/595,727 and 09/565,639, which are herein incorporated by reference. A person skilled in the art will thus understand that the invention may have additional embodiments, or that the invention may be practiced without several of the details described below.

Figure 1:
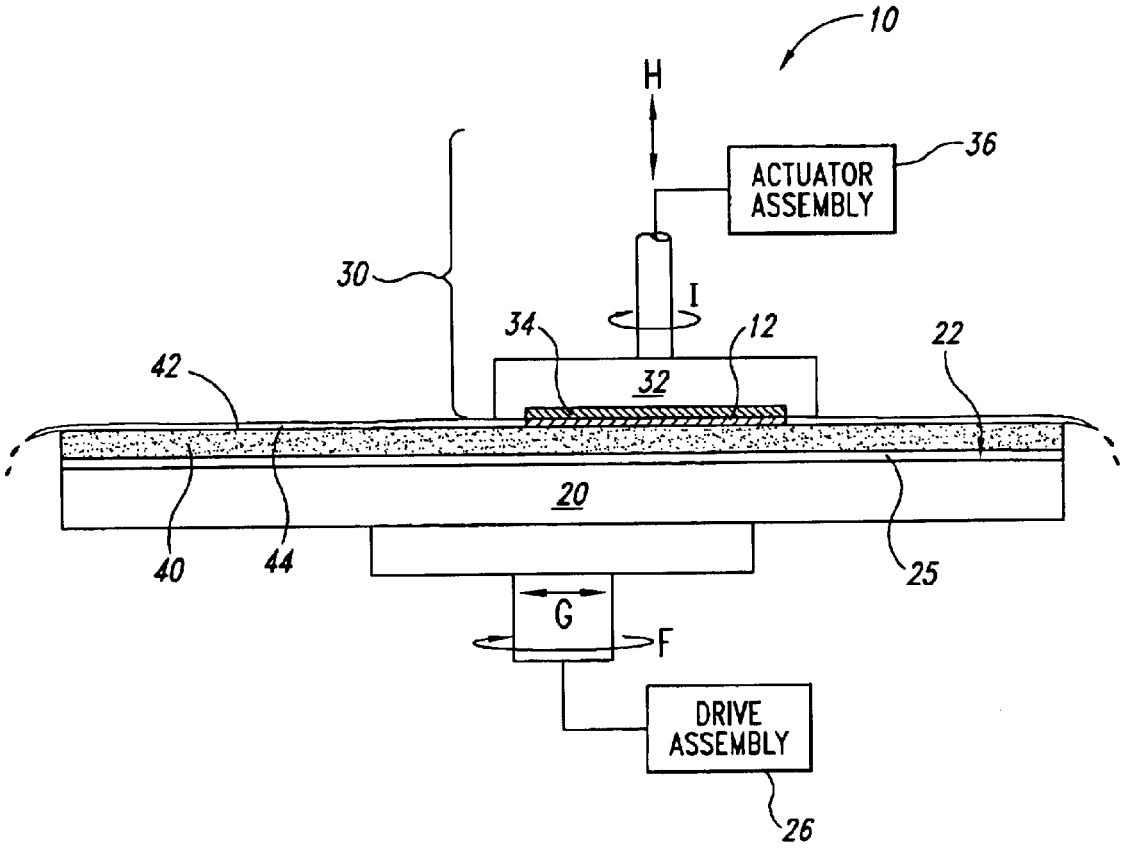
Fig. 1 (Prior Art)
FIG. 1 is a cross-sectional view of a planarizing machine in accordance with the prior art with selected components shown schematically.
Figure 2:
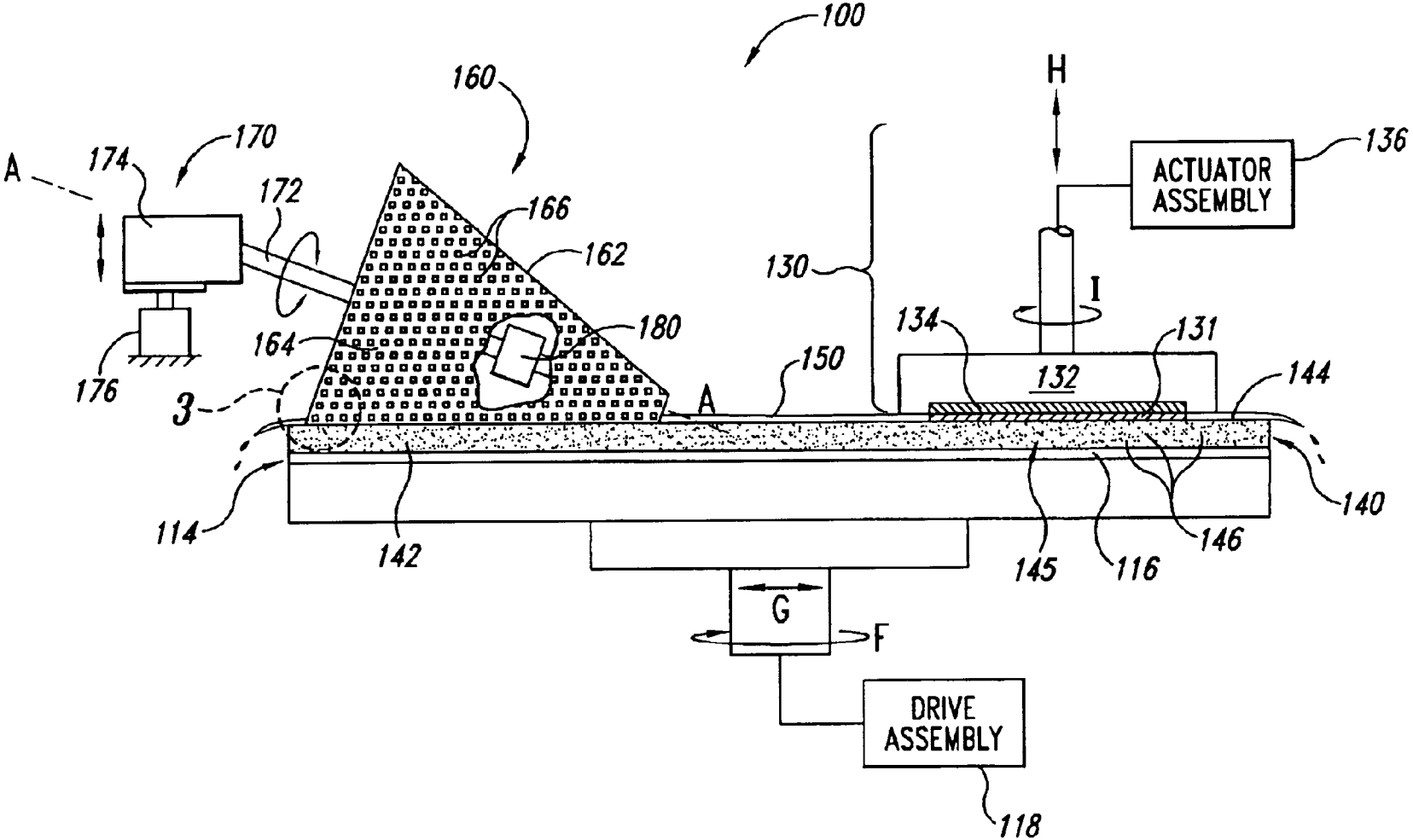
FIG. 2 is a side elevation view of a planarizing system including a conditioning assembly in accordance with an embodiment of the invention with selected components shown in cross section or schematically.

FIG. 2 is a cross-sectional view of a planarizing system 100 having a conditioning assembly 160 in accordance with an embodiment of the invention. The planarizing machine 100 has a table 114 with a top panel 116. The top panel 116 is generally a rigid plate to provide a flat, solid surface for supporting a processing pad. In this embodiment, the table 114 is a rotating platen that is driven by a drive assembly 118.

The planarizing machine 100 also includes a workpiece carrier assembly 130 that controls and protects a microelectronic workpiece 131 during planarization or electrochemical-mechanical planarization/deposition processes. The carrier assembly 130 can include a workpiece holder 132 to pick up, hold and release the workpiece 131 at appropriate stages of a planarizing cycle and/or a conditioning cycle. The workpiece carrier assembly 130 also generally has a backing member 134 contacting the backside of the workpiece 131 and actuator assembly 136 coupled to the workpiece holder 132. The actuator assembly 136 can move the workpiece holder 132 vertically (arrow H), rotate the workpiece holder 132 (arrow I), and/or translate the workpiece holder 132 laterally. In a typical operation, the actuator assembly 136 moves the workpiece holder 132 to press the workpiece 131 against a processing pad 140.

The processing pad 140 shown in FIG. 2 has a planarizing medium 142 and a contact surface 144 for selectively removing material from the surface of the workpiece 131. The planarizing medium 142 can have a binder 145 and a plurality of abrasive particles 146 distributed throughout at least a portion of the binder 145. The binder 145 is generally a resin or another suitable material, and the abrasive particles 146 are generally alumina, ceria, titania, silica or other suitable abrasive particles. At least some of the abrasive particles 146 are partially exposed at the contact surface 144 of the processing pad 140. Suitable fixed-abrasive planarizing pads are disclosed in U.S. Pat. Nos. 5,645,471; 5,879,222; 5,624,303; and U.S. patent application Ser. Nos. 09-164,916 and 09-001,333; all of which are herein incorporated by reference. In other embodiments the processing pad 140 can be a non-abrasive pad without abrasive particles, such as a Rodel OXP 3000 "Sycamore" polishing pad manufactured by Rodel Corporation. The Sycamore pad is a hard pad with trenches for macro-scale slurry transportation underneath the workpiece 131. The contact surface 144 can be a flat surface, or it can have a pattern of micro-features, macrogrooves, and/or other features.

Referring still to FIG. 2, the conditioning assembly 160 can include an end-effector 162 carried by an end-effector carrier assembly 170. The end-effector 162 can include a conditioning surface 164 and a plurality of microstructures 166 on the conditioning surface 164. The end-effector 162 shown in FIG. 2 is a conical roller in which the conditioning surface 164 has a frusto-conical shape. The conical roller is configured so that the linear velocity of the conditioning surface 164 corresponds to the linear velocity of the contact surface 144 along the radius of the contact pad 140. For example, for a pad having a radius of "X" and a conical roller having a diameter of "Y" at the base, the angle θ of the conical roller is:

$$\theta = a\sin\left(\frac{y}{x}\right)$$

The conical conditioning surface 164 is expected to provide consistent results because the parity of the linear velocity with the contact surface 144 along the radius of the processing pad 140 is expected to reduce slippage between the end-effector 162 and the pad 140.

The microstructures 166 can be raised features that project radially outwardly from the conditioning surface 164, depressions in the conditioning surface 164, or any combination of structures. The microstructures are typically arranged in a pattern and have shapes corresponding to a pattern of microfeatures and/or macrogrooves on the contact surface 144 of the processing pad 140. For example, when the pad has macrogrooves for transporting the planarizing solution, the microstructures 166 could be concentric bands around the end-effector 162. The microstructures 166 can be arranged in patterns in which several different types of microstructures 166 are combined in a desired pattern on the conditioning surface 164. In operation, the end-effector 162 embosses or imprints the pattern of the microstructures 166 on the contact surface 144 of the pad 140 as the end-effector 162 rolls with the pad 140.

The end-effector carrier assembly 170 shown in FIG. 2 includes an arm 172, a rotary drive unit 174 coupled to the arm 172, and a vertical actuator 176 also coupled to the arm 172. The arm 172 can be a shaft, and the rotary drive unit 174 can be an electrical, pneumatic, hydraulic or another type of suitable motor for rotating the arm 172 about axis A—A. In the embodiment shown in FIG. 2, the vertical actuator 176 is coupled to the arm 172 via the rotary drive unit 174 such that the vertical actuator 176 lifts both the rotary drive unit 174 and the arm 172. In operation, a desired downforce is applied to the end-effector 162 to imprint or otherwise impart the desired surface condition to the contact surface 144. The rotary drive unit 174 rotates the end-effector 162 so that the linear velocity of the contact surface 164 is at a desired ratio relative to the pad 140. As explained above, the velocity ratio is usual 1:1, but it can be different such that the linear velocity of the end-effector 162 is different than that of the pad 140.

In an alternate embodiment, the end-effector assembly 170 does not include a rotary drive unit 174, but rather the end-effector 162 is rotatably mounted to the arm 172 by a bearing 168 or other rotary connection. This embodiment operates by pressing the end-effector 162 against the pad 140 so that the friction between the pad 140 and the end-effector 162 rotates the end-effector 162 about the arm 172.

The conditioning assembly 160 can also include a heater 180. In the embodiment shown in FIG. 2, the heater 180 is in the end-effector 162 to heat the conditioning surface 164 and the microstructures 166. Alternative embodiments of the conditioning assembly 160 can include a heater that is separate from the end-effector 162. The heater 180 can be an electrical element or a plurality of electrical elements extending through the end-effector 162 near the conditioning surface 164. The heater 180 can alternatively be a manifold system within the end-effector 162 for carrying a heated fluid (e.g., a hot gas or liquid) throughout the end-effector 162. The conditioning surface 164 is heated to increase the plasticity of the planarizing medium 142 so that the end-effector 162 can more effectively emboss the pattern of the microstructures 166 onto the contact surface 144 of the processing pad 140. The temperature of the conditioning surface 164 is selected to heat the planarizing medium 142 of the pad 140 to a temperature at least relatively near its glass transition temperature so that the contact surface 164 and/or the microstructures 166 can precisely impart the desired topography to the contact surface 144 of the pad 140. For example, if the planarizing medium 142 is a urethane, the heater 180 can heat the contact surface 144 of the pad 140 to approximately 35–190° C., or in some applications 100–180° C., or in more specific applications 120–180° C. The temperature of the conditioning surface 164 will generally be higher than the desired temperature of the contact surface 144 because the pad 140 only contacts the end-effector 162 for a moment. Additionally, other temperature ranges can be used for urethane pads or pads having other types of planarizing media.

Figure 3:
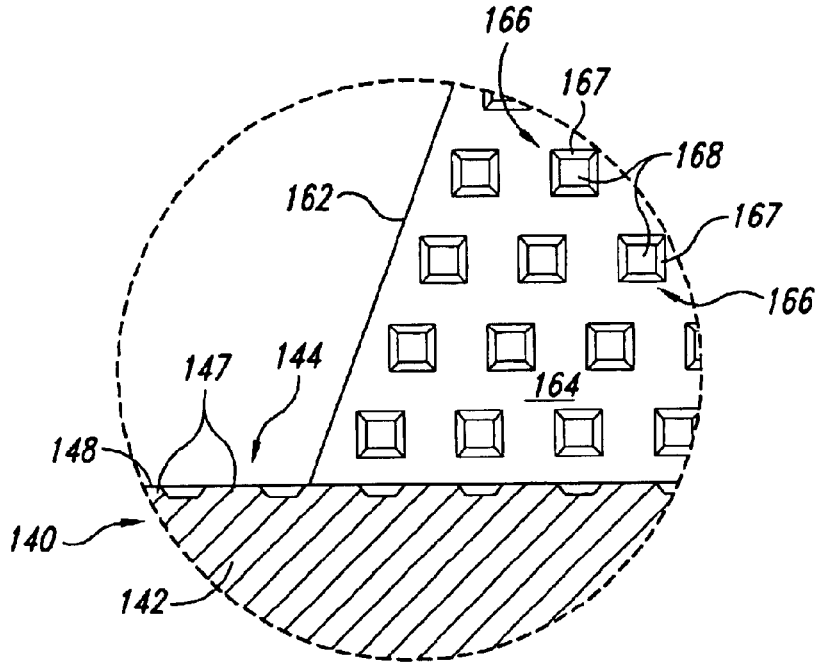
FIG. 3 is a side elevation view showing a cross-sectional portion of a processing pad and a detailed portion of a conditioning assembly in accordance with an embodiment of the invention.

FIG. 3 is a side elevation view showing a cross-sectional portion of the processing pad 140 and a side elevation view of a portion of the end-effector 162 in greater detail. In this embodiment, the contact surface 144 of the processing pad 140 has a plurality of microfeatures 147 defined by truncated pyramids. The microfeatures 147 are arranged in a desired pattern across the contact surface 144, and the microfeatures 147 have bearing surfaces 148 for contacting the workpiece. The processing pad 140 can also include a plurality of trenches that can be macro-trenches for transporting planarizing fluid or micro-trenches for holding small volumes of fluid relative to the workpiece as it moves across the contact surface 144. The end-effector 162 can accordingly have a plurality of microstructures 166 defined by truncated pyramids that project from the conditioning surface 164 in a pattern corresponding to the pattern of the microfeatures 147 on the contact surface 144. The microstructures 166 on the end-effector 162 can have side walls 167 that project away from the conditioning surface 164 and bearing surfaces 168. The side walls 167 can have a height of approximately 1 to 500 $\mu$m, and the bearing surfaces 168 can have a surface area of approximately 1 to 200 $\mu m^2$. Additionally, the microstructures 166 can be spaced apart from each other by approximately 1 to 200 $\mu$m. It will be appreciated that in alternate embodiments the microstructures can be depressions in the conditioning surface 164 that have the shape of an inverted truncated pyramid. Additionally, the microstructures 166 are not limited to the foregoing shapes, spacing, sizes and/or patterns, but rather the configuration of the microstructures 166 generally is generally determined to provide the desired surface condition on the contact surface 144. Alternate embodiments of the end-effector 162 can have a smooth contact surface 144 without microstructures 166.

FIGS. 2 and 3 together illustrate the operation of the conditioning assembly 160 to condition the pad 140. In one embodiment, the end-effector 162 is pressed against the contact surface 144 of the pad 140. The down force of the end-effector 162 can be selected to emboss the design of the microstructures 166 onto the contact surface 144. The end-effector 162 can also be heated to a temperature that will impart the desired plasticity to the material of the pad 140 to further enhance the precision with which the end-effector 162 can reform the contact surface 144 of the pad 140. As the end-effector 162 presses against the pad 140, the rotary drive unit 174 rotates the end-effector 162 in coordination with the rotation of the processing pad 140. One aspect of operating the conditioning assembly 160 in this matter is that the contact surface 144 will be refurbished to correspond to the pattern of the conditioning surface 164 of the end-effector 162. In one embodiment, the end-effector 162 conditions the contact surface 144 in situ and in real time during a processing cycle in which the workpiece 131 also contacts the pad 140. In alternate embodiments, the end effector 162 is pressed against the pad 140 between processing cycles such that the workpiece 131 is not engaged with pad 140 during an independent conditioning cycle.

Several embodiments of the planarizing system 100 are expected to produce a consistent contact surface on hard polishing pads for enhancing the planarizing results of chemical-mechanical planarization and/or electrochemical-mechanical planarization/deposition. The conditioning assembly 160 refurbishes the contact surface 144 of the pad 140 because it precisely reforms microfeatures on the contact surface 144. One feature of the conditioning assembly 160 that allows the end-effector 162 to precisely reform microfeatures on the contact surface 144 is that the microstructures 166 can consistently contact desired areas on the processing pad 140. Additionally, the microstructures 166 can be formed in precise shapes, sizes and patterns using precision machining and/or etching techniques. Therefore, several embodiments of the conditioning assembly 160 are expected to consistently reform the microfeatures on the contact surface 144 to provide consistent planarizing results.

Several embodiments of the conditioning assembly 160 are also expected to enhance the throughput of finished wafers because the hard polishing pads can be conditioned in situ and in real time during a processing cycle. Because the conditioning assembly 160 embosses or imprints the desired pattern of microfeatures on the contact surface 144, it is not necessary to use a diamond end-effector that is subject to producing defects in the processing pad and/or the workpiece for the reasons explained above. Several embodiments of the conditioning assembly 160 are accordingly useful for conditioning the processing pad during the processing cycle so that the planarizing machine 100 is not subject to downtime for conditioning the processing pad 140 during an independent conditioning cycle. Therefore, several embodiments of the conditioning assembly 160 are also expected to enhance the throughput of finished workpieces.

The embodiments of the conditioning assembly 160 shown in FIGS. 2 and 3 are also expected to enhance the life of processing pads. Unlike conventional diamond end-effectors that produce microscratches on the surface of the processing pad, the conditioning system 160 is expected to reform the microfeatures on the contact surface of the pad without abrading material from the pad. This is expected to enhance the life of the processing pads because the abrasion caused by conventional diamond end-effectors wears down areas of the pads such that raised features, depressions and/or trenches in the pads do not produce consistent planarizing results. Several embodiments of the conditioning assembly 160 eliminate this problem because they do not remove material from the processing pad, but rather they reform the shape or the contour of the contact surface of the processing pad so that it provides a consistent pattern of raised features and/or trenches. Therefore, several embodiments of the conditioning assembly 160 are expected to enhance the life of processing pads.

Figure 4:
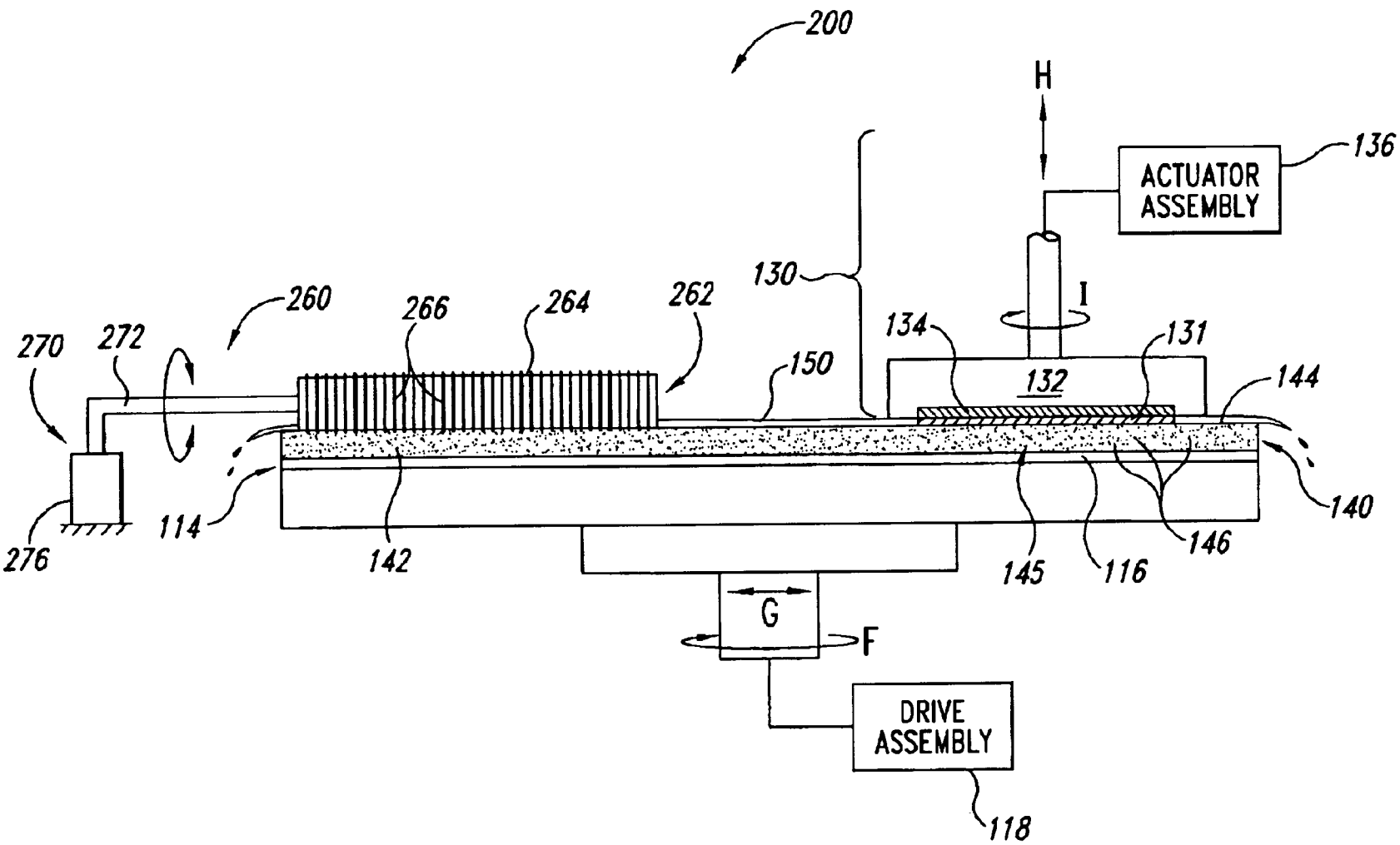
FIG. 4 is a side elevation view of a planarizing system including a conditioning assembly in accordance with another embodiment of the invention with selected components shown in cross section or schematically.

FIG. 4 is a cross-sectional view of a planarizing system 200 having a conditioning assembly 260 in accordance with another embodiment of the invention. The planarizing machine 200 has a table 114, a carrier assembly 130, and a processing pad 140, which can be the same or at least substantially similar to those described above with reference to FIG. 2. It will be appreciated that like reference numbers refer to like components in FIGS. 2–4.

The conditioning assembly 260 can include an end-effector 262 carried by an end-effector carrier assembly 270. The end-effector 262 can include a conditioning surface 264 and a plurality of microstructures 266. In this embodiment, the end-effector 262 is a cylindrical roller with a cylindrical conditioning surface 264. The microstructures 266 can be a plurality of fins for forming grooves in the contact surface 144 of the processing pad 140. The grooves can be microgrooves and/or macrogrooves, and as explained above the microstructures 266 can have other shapes.

The end-effector carrier assembly 270 shown in FIG. 4 includes an arm 272 and a vertical actuator 276. The end-effector 262 can further include a bearing that couples the end-effector 262 to the arm 270 so that the friction between the end-effector 162 and the pad 140 can rotate the end-effector 162 about the arm 272. In one embodiment, the end-effector carrier assembly 270 can also include a rotary drive unit (not shown in FIG. 4) similar to the rotary drive unit 174 shown in FIG. 2 to rotate the cylindrical end effector 262. The conditioning assembly 260 is expected to operate in much the same manner as explained above with reference to the conditioning assembly 160.

Figure 5:
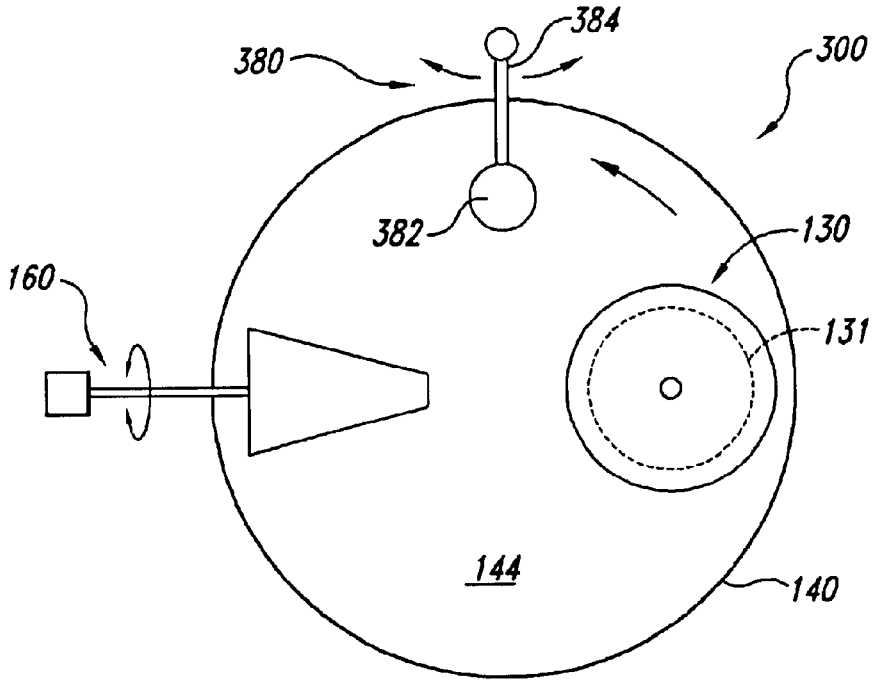
FIG. 5 is a top plan view of a planarizing system including a conditioning assembly in accordance with another embodiment of the invention.

FIG. 5 is a top plan view of a planarizing system 300 having a wafer carrier assembly 130, a processing pad 140, and a conditioning assembly 160 that are the same as those described above with reference to FIG. 2. The planarizing system 300 also includes a secondary conditioning assembly 380 including an abrasive end-effector 382 and an actuator 384. The secondary conditioning assembly 380 can be a diamond embedded end-effector for producing microscratches on the contact surface 144 of the processing pad or a brush for removing debris from the pad. The planarizing machine 300 can operate in a manner similar to the planarizing machine 100 described above with reference to FIG. 2, but the secondary conditioning assembly 380 is typically not activated during a planarizing cycle. One advantage of the planarizing system 300 is that the abrasive end-effector 382 of the secondary conditioning assembly 380 can remove glazed material from the contact surface 144, and then the conditioning assembly 160 can reform the microfeatures on the contact surface 144. The planarizing system 300, however, may produce defects in the processing pad 140 and/or the workpiece 131 because the diamond particles or the abrasive matter on the abrasive end-effector 382 can cause defects during a planarizing cycle.

Figure 6:
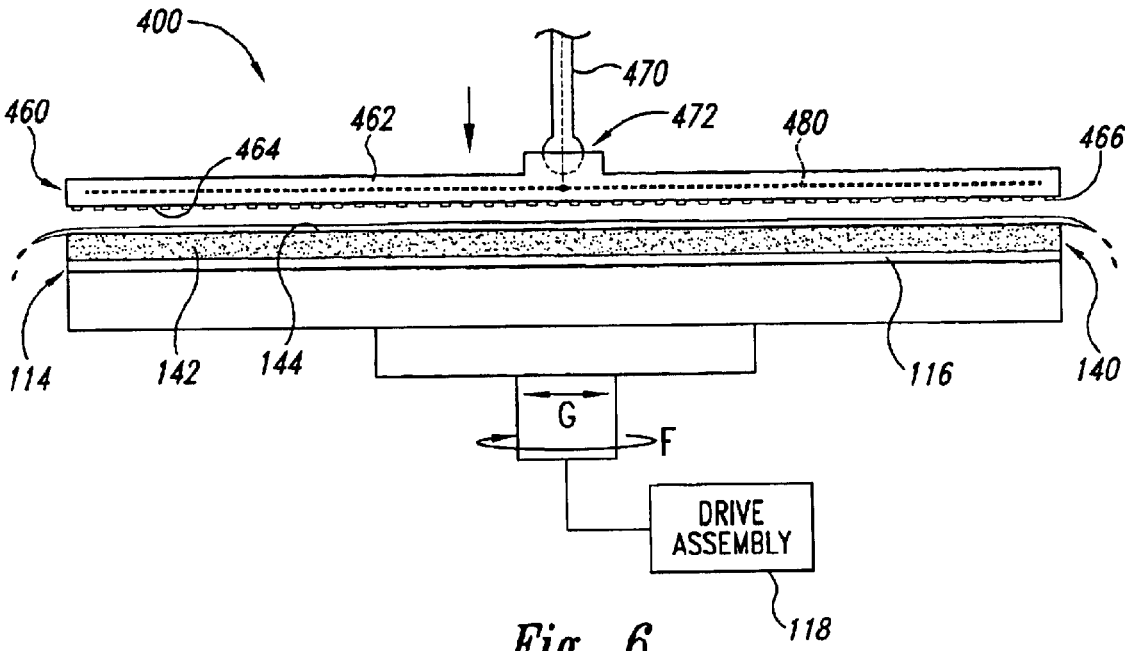
FIG. 6 is a side elevation view of a planarizing system with a conditioning assembly in accordance with an embodiment of the invention with selected components shown in cross-section or schematically.

FIG. 6 is a side elevation view of another planarizing machine 400 having a conditioning assembly 460 in accordance with another embodiment of the invention. The planarizing machine 400 can include a table 114, a drive assembly 118, and a processing pad 140 that are similar to those described above with reference to the planarizing machine 100 of FIG. 2. As such, like reference numbers refer to like components in FIGS. 2 and 6.

The conditioning assembly 460 can include an end-effector 462 having a conditioning surface 464 with a plurality of microstructures 466. The end-effector 462 can be a large plate that is approximately the same size and shape as the processing pad 140. Alternate embodiments of the conditioning assembly 460 can have plates that are much smaller than the pad to condition a discrete section of the pad 140. The microstructures 466 in this embodiment are cylindrical posts that project from the conditioning surface 464, but it will be appreciated that other types of microstructures can be used on the conditioning surface 464. The conditioning assembly 460 also includes an actuator 470 that can be coupled to the end-effector 462 by a gimbal joint 472 or another type of connector. The conditioning system 460 can also include a heater 480, such as a plurality of resistive electrical wires in the end-effector 462 or pathways for a heated fluid.

The conditioning assembly 460 operates by heating the end-effector 462 to a desired temperature and then moving the end-effector 462 downward to press the microstructures 466 and the conditioning surface 464 against the contact surface 144 of the pad 140. The conditioning assembly 460 accordingly embosses or imprints the pattern of the microstructures 466 onto the contact surface 144 of the pad 140.

Figure 7A:
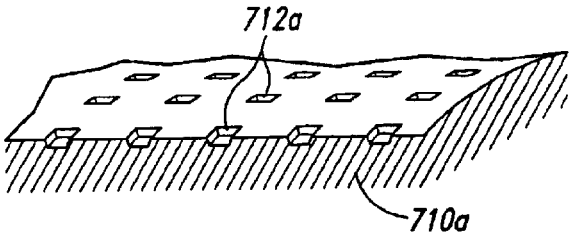
FIGS. 7A–7C are cross-sectional, isometric views of conditioning surfaces on conditioning assemblies in accordance with various embodiments of the invention.
Figure 7B:
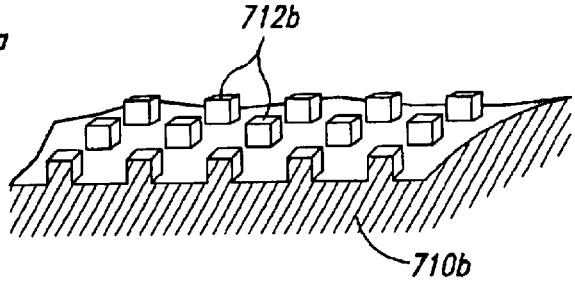
Figure 7C:
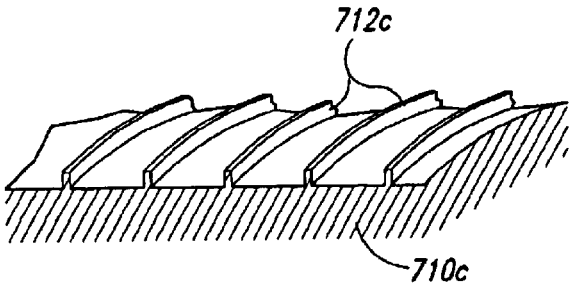

FIGS. 7A–7C are partial isometric cross-sectional views of various additional embodiments of end-effectors for use with conditioning assemblies in accordance with embodiments to the invention. Referring to FIG. 7A, the end-effector 710*a* can have a plurality of microstructures 712*a* defined by depressions in the shape of truncated pyramids, cylinders, spheres, cones, or any other shapes that are suitable for embossing raised features on the surface of the processing pad. FIG. 7B illustrates an embodiment of an end-effector 710*b* having microstructures 712*b* defined by rectilinear posts. FIG. 7C illustrates an end-effector 710*c* having a plurality of microstructures 712*c* defined by fins that project away from the conditioning surface. It will be appreciated that the microstructures can have other shapes and sizes.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

What is claimed is:

1. A processing machine for processing microelectronic workpieces, comprising:

a table;

a processing pad coupled to the table, the processing pad comprising a planarizing medium having a contact surface defined by a plurality of microfeatures having bearing surfaces;

a microelectronic workpiece support assembly having a head for holding a microelectronic workpiece and a drive mechanism connected to the head, the drive mechanism controlling the head to move the microelectronic workpiece with respect to the processing pad;

a carrier assembly having a holder positionable over the processing pad; and an end-effector carried by the holder, the end-effector comprising a conditioning surface configured to engage the contact surface of the processing pad, and a plurality of microstructures on the conditioning surface, the microstructures being spatially arranged in a pattern corresponding to a desired pattern of microfeatures to be imparted on the contact pad, and the microstructures being raised elements projecting from the conditioning surface and/or depressions in the conditioning surface.

2. The machine of claim 1 wherein:

the end-effector comprises a plate having a backside with a joint for connecting the plate to the holder and the conditioning surface defines a front side of the plate; and the microstructures comprise raised features spaced apart from one another in the pattern.

3. The machine of claim 1 wherein:

the end-effector comprises a plate and a heater carried by the plate, the plate having a backside with a joint for connecting the plate to the holder and the conditioning surface defines a front side of the plate; and the microstructures comprise raised features spaced apart from one another in the pattern.

4. The machine of claim 1, further comprising a heater carried by the end-effector.

5. The machine of claim 1 wherein the microstructures comprise raised features spaced apart from one another in the pattern.

6. The machine of claim 1 wherein the microstructures comprise truncated pyramids spaced apart from one another across the conditioning surface.

7. The machine of claim 1 wherein the microstructures comprise posts projecting from the end-effector across the conditioning surface.

8. The machine of claim 1 wherein the microstructures comprise rectilinear posts projecting from the end-effector across the conditioning surface.

9. The machine of claim 1 wherein the microstructures comprise cylindrical posts projecting from the end-effector across the conditioning surface.

10. The machine of claim 1 wherein the microstructures comprise depressions in the end-effector.

11. The machine of claim 1 wherein the microstructures comprise mounds projecting from the end-effector.

12. The machine of claim 1 wherein the microstructures comprise raised features projecting from the end-effector by a distance of approximately 1 to 500 $\mu$m.

13. The machine of claim 1 wherein the microstructures comprise raised features that (a) project from the end-effector by a distance of approximately 1 to 500 $\mu$m, (b) have a bearing surface of approximately 1 to 200 $\mu m^2$, and (c) are spaced apart from each other by approximately 1 to 200 $\mu$m.

14. The machine of claim 1 wherein the microstructures comprise raised features spaced apart from one another in the pattern, the raised features being truncated pyramids.

15. The machine of claim 1 wherein:

the end-effector comprises a heater to heat the conditioning surface; and the microstructures comprise raised features spaced apart from one another in the pattern, the raised features being truncated pyramids.

16. The machine of claim 1 wherein the microstructures comprise raised features spaced apart from one another in the pattern, the raised features being truncated pyramids that (a) project from the end-effector by a distance of approximately 1 to 500 $\mu$m, (b) have a bearing surface of approximately 1 to 200 $\mu m^2$, and (c) are spaced apart from each other by approximately 1 to 200 $\mu$m.

17. A processing machine for processing microelectronic workpieces, comprising:

a table;

a processing pad coupled to the table, the processing pad comprising a planarizing medium having a contact surface;

a microelectronic workpiece support assembly having a head for holding a microelectronic workpiece and a drive mechanism connected to the head, the drive mechanism controlling the head to move the microelectronic workpiece with respect to the processing pad;

a carrier assembly having a holder positionable over the processing pad;

an end-effector having a conditioning surface configured to engage the contact surface of the processing pad; and a heater coupled to the end-effector to provide heat to the conditioning surface.

18. The machine of claim 17, further comprising microstructures on the conditioning surface.

19. The machine of claim 18 wherein the microstructures comprise raised features projecting from the end-effector across the conditioning surface.

20. The machine of claim 18 wherein the microstructures comprise depressions in the end-effector.

21. The machine of claim 18 wherein the microstructures comprise raised features projecting from the end-effector by a distance of approximately 1 to 500 $\mu$m.

22. The machine of claim 18 wherein the microstructures comprise raised features that (a) project from the end-effector by a distance of approximately 1 to 500 $\mu$m, (b) have a bearing surface of approximately 1 to 200 $\mu m^2$, and (c) are spaced apart from each other by approximately 1 to 200 $\mu$m.

* * * * *